US005590552A

United States Patent [19]

Kim

[11] Patent Number: 5,590,552

[45] Date of Patent: Jan. 7, 1997

[54] CLOTHES WASHER HAVING A SUDS-REMOVAL SYSTEM

[75] Inventor: Young-Min Kim, Suwon, Rep. of Korea

[73] Assignee: Samsung Electronics Co., Ltd., Suwon, Rep. of Korea

[21] Appl. No.: 358,315

[22] Filed: Dec. 19, 1994

[30] Foreign Application Priority Data

Jan. 29, 1994 [KR] Rep. of Korea ..... 94-1697
Jul. 15, 1994 [KR] Rep. of Korea ..... 94-17616

[51] Int. Cl.[6] ..... D06F 39/08
[52] U.S. Cl. ..... 68/207
[58] Field of Search ..... 68/207, 23.5

[56] References Cited

U.S. PATENT DOCUMENTS

| | | | |
|---|---|---|---|
| 2,611,256 | 9/1952 | Candor | 68/23.5 X |
| 2,885,879 | 5/1959 | Bloom | 68/207 |
| 2,934,928 | 5/1960 | Shelton | 68/207 |
| 3,513,866 | 5/1970 | Boothe et al. | 68/207 X |
| 3,575,020 | 4/1971 | Hubbard | 68/23.5 X |
| 3,670,533 | 6/1972 | Worst | 68/207 |
| 4,464,914 | 8/1984 | Torita | 68/23.5 |

FOREIGN PATENT DOCUMENTS

| | | | |
|---|---|---|---|
| 36558 | 9/1984 | Japan | 68/207 |
| 719 | 1/1987 | Japan | 68/207 |

*Primary Examiner*—Philip R. Coe
*Attorney, Agent, or Firm*—Burns, Doane, Swecker & Mathis, L.L.P.

[57] ABSTRACT

A clothes washing machine includes inner and outer tubs. Wash water is supplied from a fresh water source to the outer tub. Following a washing cycle, fresh water is directed into the inner tub to eliminate soap suds therefrom and thereby increase the effectiveness of a subsequent rinsing cycle. The suds-eliminating water is introduced into the inner tub from an apertured ring extending around an upper edge of the inner tub. The ring can also direct fresh water into a space formed between the inner and outer tubs to further promote the removal of suds.

7 Claims, 5 Drawing Sheets

CLOTHES WASHER HAVING A SUDS-REMOVAL SYSTEM

BACKGROUND OF THE INVENTION

1. Field of the Invention

The present invention relates to a washing machine (hereinafter refer to as "washer"), and more particularly to a water supply apparatus of a washer by which washing water can be evenly supplied to the laundry to easily eliminate soap suds generated during the washing.

2. Description of the Prior Art

FIG. 1 is a longitudinal sectional view for illustrating a conventional washer.

As illustrated in FIG. 1, a water tub 2 is fixedly mounted on a body 1 of the washer. The water tub 2 is fixedly disposed at a bottom thereof with a driving apparatus 3 for selectively driving a washing tub 4 and a pulsator 5 by receiving a turning effect of a motor 9 through a belt 12.

In other words, the washing tub 4 for washing and drying by way of centrifugal force generated by the driving of the motor 9 is disposed in the water tub 2, so that the same can be rotatably mounted to a driving shaft 3*a* of the driving apparatus 3. Within the washing tub 4, there is disposed the pulsator 5 for being rotated backward and forward on the driving shaft 3*a* of the driving apparatus 3, so that the pulsator 5 can perform the washing by way of a formation of water current in the washing water stored in the washing tube 4 while being rotated backward and forward according to the driving of the motor 9.

A water supply means 7 is disposed at an upper side of the body 1 of the washer in order to supply water through a pipe (not shown) into the water tub 2 connected to a faucet 6, and a solenoid valve 10 is disposed between the faucet 6 and the water supply means 7.

A water discharge means including a water discharge solenoid valve 8 for discharging the washing water is disposed at a lower surface of the water tub 2.

A ring-shaped guide cover 11 is disposed at an upper side of the water tub 2.

In a conventional washer thus described, when the laundry is thrown into the washing tub 4 disposed within the water tub 2, and a washing condition is selected on a control panel (not shown), the solenoid valve 10 is activated to thereby cause the hot water or cold water to be supplied into the washing tub 4 through the water supply means 7.

When an adequate quantity of water necessary for the washing is supplied into the washing tub 4, a turning effect of the motor 9 is transferred to the driving apparatus 3 through a belt according to the activation of the motor, and the pulator 5 is rotated according to the driving of the driving apparatus 3.

At this time, the pulsator repeats clockwise and counter-clockwise rotations (i.e. the pulsator oscillates) to thereby wash the laundry by forming a water current in the washing tub 4.

When the washing is completed, the water discharge valve 8 is activated by a control means (not shown) to thereafter discharge the washing water from the water tub 2.

Thereafter, cold and warm rinsing water is supplied to the water tub 2 for a number of rinsing and water discharging steps, and the washing tub 4 is rotated at high speed according to the driving of the driving apparatus 3 to thereafter perform the spin-drying.

However, there is a problem in the thus-described conventional washer in that the soap suds created by detergent remain on the laundry in the washing tub 4, although the washing cycle has been completed and the washing water has been discharged according to the activation of the water discharge valve 8.

There is another problem in that, because the soap suds remain on a floor surface of the water tub 2 following a water discharge step, the subsequent rinsing effect of the laundry is reduced by the soap suds remaining even during the rinsing cycle, even though fresh water is supplied through the water supply means 7 in order to perform the rinsing.

There is still another problem in that much water is needed to perform the number of rinsing cycles because of the reduced effect of the rinsing.

There is still a further problem in that the repeated driving of the driving unit for accomplishing the rinsing cycles increases electric consumption.

SUMMARY OF THE INVENTION

The present invention has been disclosed to solve the aforesaid problem, and it is an object of the present invention to provide a water supply apparatus of a washing machine by which the soap suds remaining in the washing tub are eleminated to thereby increase the rinsing effect of the laundry and to reduce the electric consumption of the driving unit.

In accordance with the object of the present invention, there is provided a water supply apparatus of a washing machine, the apparatus comprising:

a water supply means for supplying the washing water to the water tub; a water sprinkling means for sprinkling the washing water into the washing tub; and a water supply switching means for selectively supplying the cold water or warm water supplied from a faucet to the water supply means or the water sprinkling means.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF A PREFERRED EMBODIMENT OF THE INVENTION

Description of the preferred embodiment according to the present invention will be described in detail with reference to the accompanying drawings.

Figure 2:
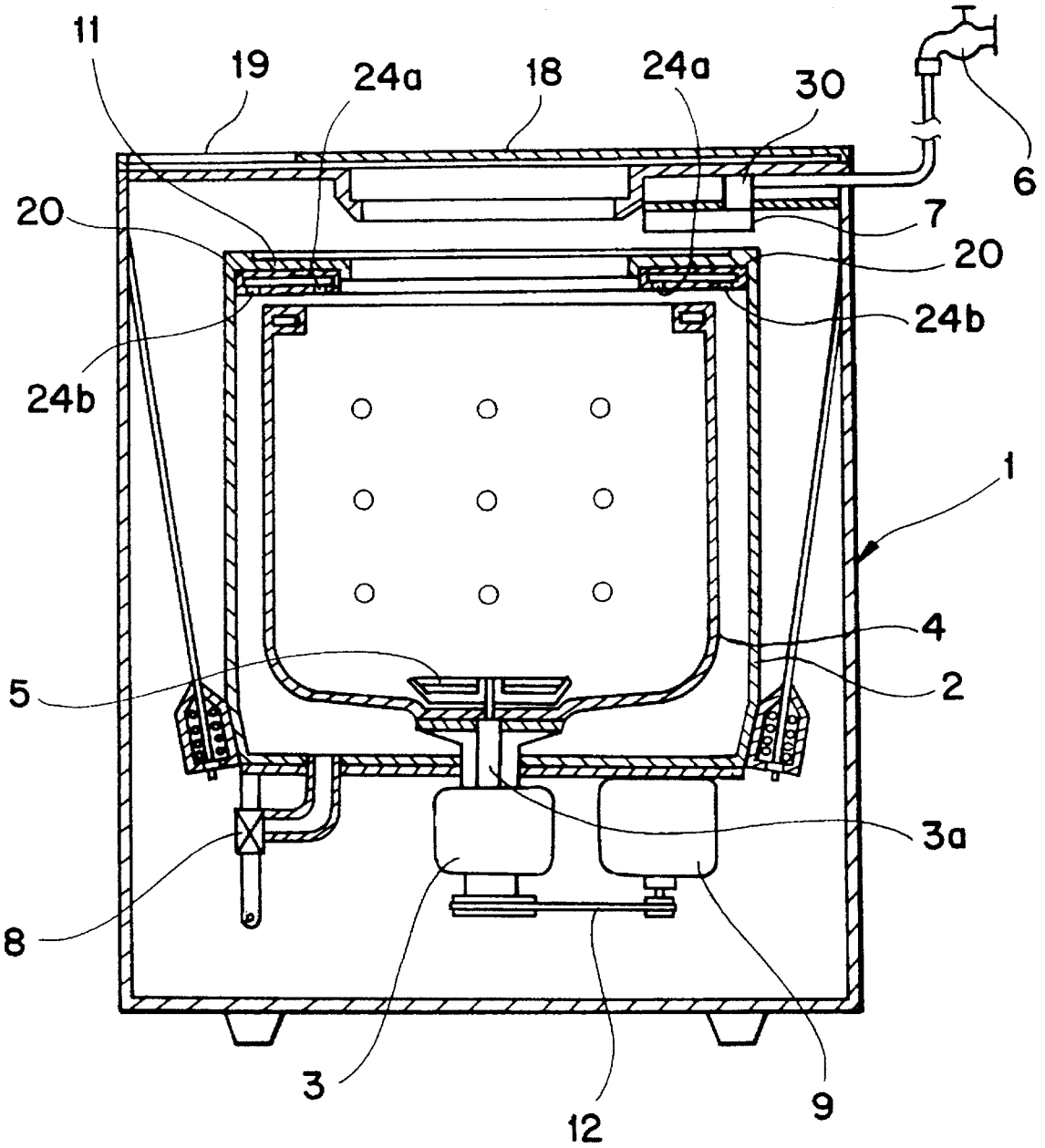
FIG. 2 is an overall longitudinal sectional view of a washing machine mounted with a water supply apparatus according to one embodiment of the present invention.
Figure 6:
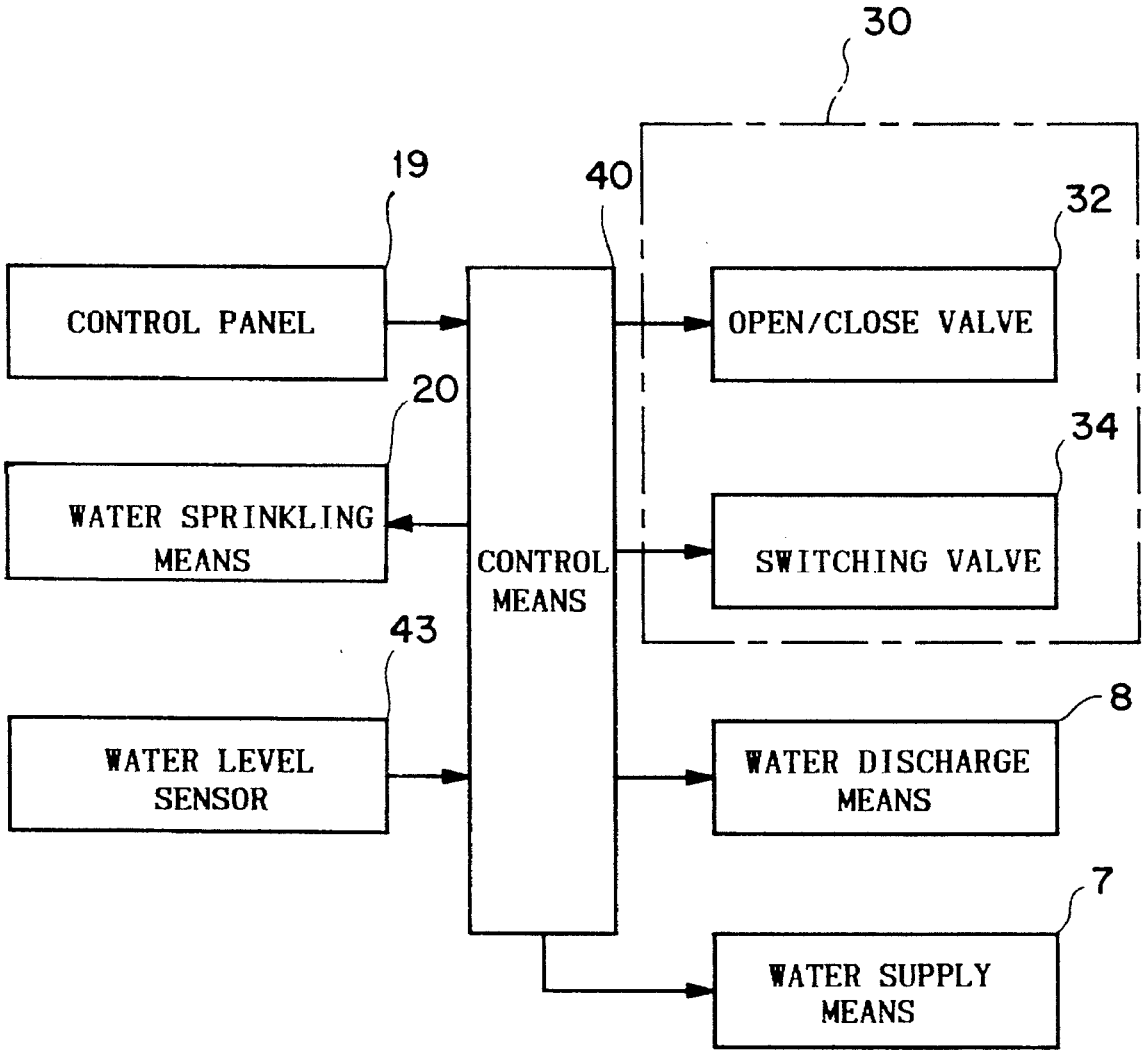
FIG. 6 is a control block diagram of the water supply apparatus in the washing machine according to the embodiment of the present invention.

FIG. 2 is an over all longitudinal sectional view of a washing machine mounted with a water supply apparatus according the one embodiment of the present invention, and FIG. 6 is a control block diagram of the water supply apparatus in the washing machine according to the embodiment of the present invention.

Figure 1:
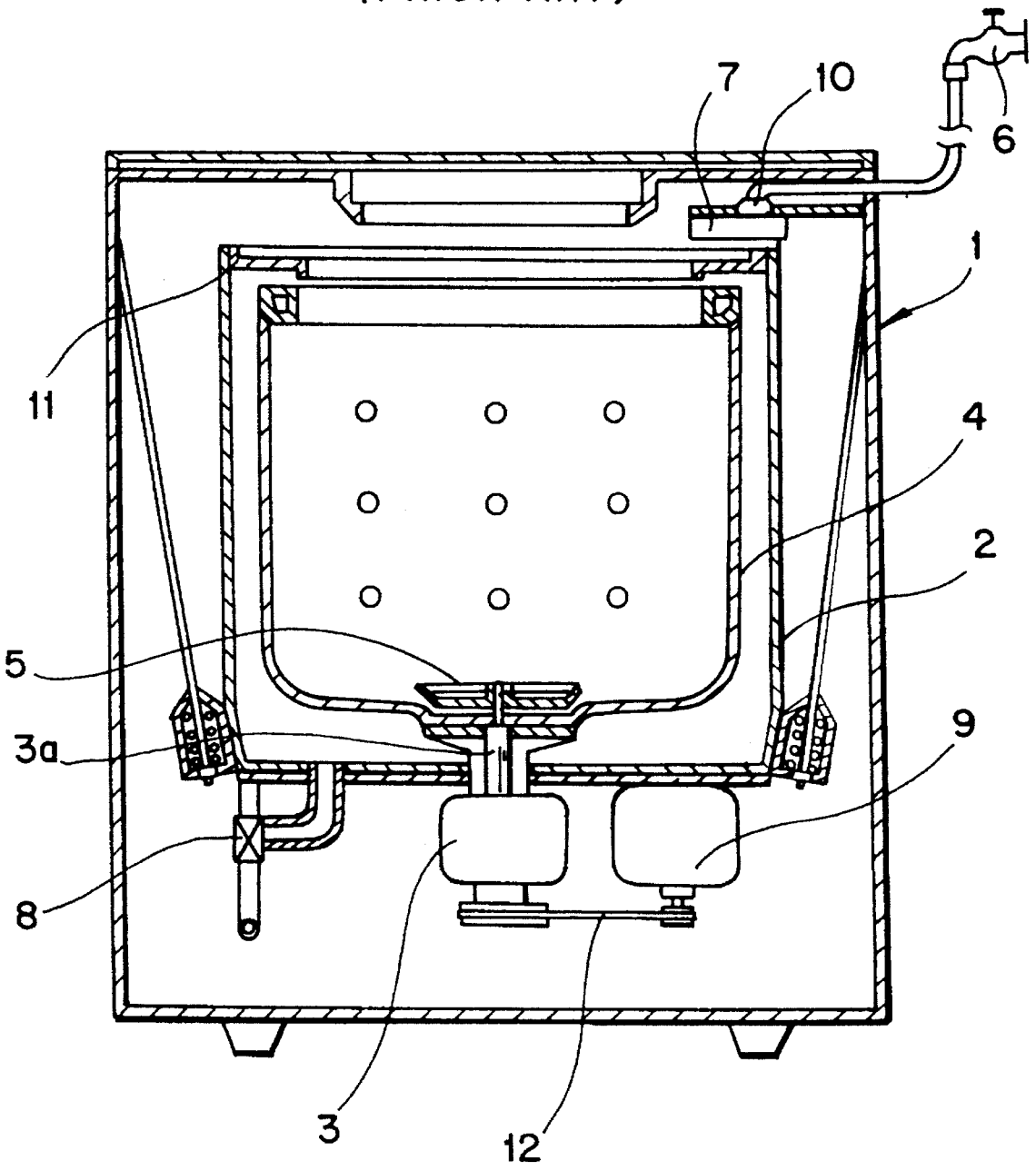
FIG. 1 (PRIOR ART)
FIG. 1 is an overall longitudinal sectional view of a conventional washing machine.

Throught the drawings in FIGS. 2 and 6, like reference numerals are used for the designation of like or equivalent parts or portions of FIG. 1 and overlapped descriptions are deleted, for simplicity of illustration and explanation.

As described in FIGS. 2 and 6, the water supply apparatus of the washer according to the present invention comprises: a water supply means 7 for supplying the washing water into the water tub 4; a water sprinkling means 20; a water supply switch means 30, a control panel 19 for inputting a user's command; a control means 40 for controlling overall operations of the washer; and a water level sensor 43 for detecting the water level of the washing water supplied into the water tub 2.

The water supply means 7 is connected at one side thereof to the faucet 6 through a pipe and is disposed at an upper side of the body 1 of the washer in order to easily supply the washing water. The ring-shaped water sprinkling means 20 is disposed at an inner side of the ring-shaped guide cover 11 formed at an upper surface of the water tub 2.

Figure 3:
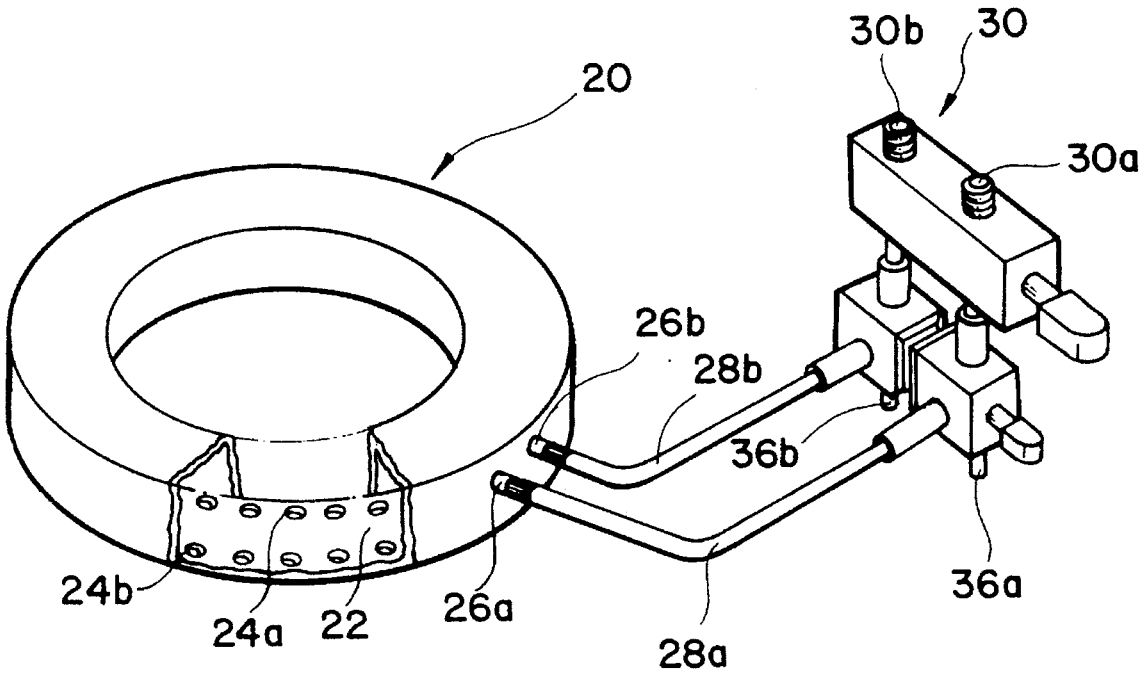
FIG. 3 is an enlarged perspective view of a washing machine mounted with a water supply apparatus according to the embodiment of the present invention.

FIG. 3 is an enlarged perspective view of the water sprinkling means 20 connected to the water supply switch means 30.

The water sprinkling means 20, as illustrated in FIG. 3, is formed in a ring-shaped pipe having a rectangular cross-section, and is spaced from the upper side of the washing tub 4. The water sprinkling means 20 has a lower surface formed with two rows of inner and external sprinkling outlets 24*a* and 24*b*, respectively.

The inner sprinkling outlets 24*a* eliminate soap suds by sprinkling the water into the washing tub 4, and the external sprinkling outlets 24*b* remove soap suds by sprinkling the water into the water tub 2.

The water supply means 7 and the sprinkling means 20 are connected to the water supply switching means 30, which in turn is connected to cold and warm water faucet 6 by way of coupling joints 30*a* and 30*b*.

In other words, the water supply switching means 30 directs the cold or warm water from the faucet 6 to the water supply means 7 or water sprinkling means 20 according to the control of the control means 40 illustrated in FIG. 6.

The water supply switching means 30 and the water sprinkling means 20 are interconnected by way of connecting pipes 28*a* and 28*b* and connecting holes 26*a* and 26*b*.

The control means 40, as illustrated in FIG. 6, controls all operations of the washer according to the user's manipulation. The control means 40 activates the water supply switching means 30 to thereby select whether the cold water or warm water is supplied to for the washing to the water tub 2. The control means 40, at the same time, controls whether that water is supplied to the water supply means 7 or the water sprinkling means 20 according to whether the washing cycle or rinsing cycle is to be performed.

Figure 4:
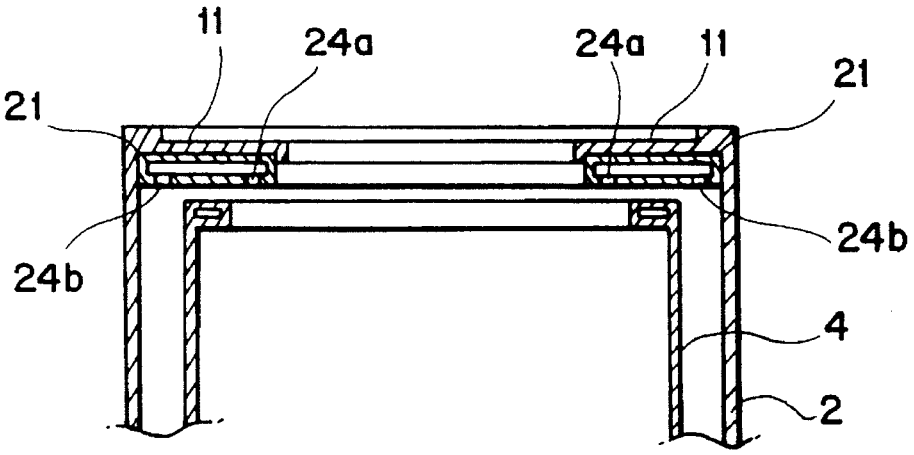
FIG. 4 is an enlarged sectional view of major parts illustrated in FIG. 2.

FIG. 4 is an enlarged sectional view of major parts illustrated in FIG. 2.

As illustrated in FIG. 4, the washing tub 4 is disposed on an inner side of the water tub 2, and the ring-shaped guide cover 11 is mounted on an upper side of the water tub 2.

The water sprinkling means 20 is disposed on a bottom surface of the guide cover 11 as illustrated in FIG. 3.

Figure 5:
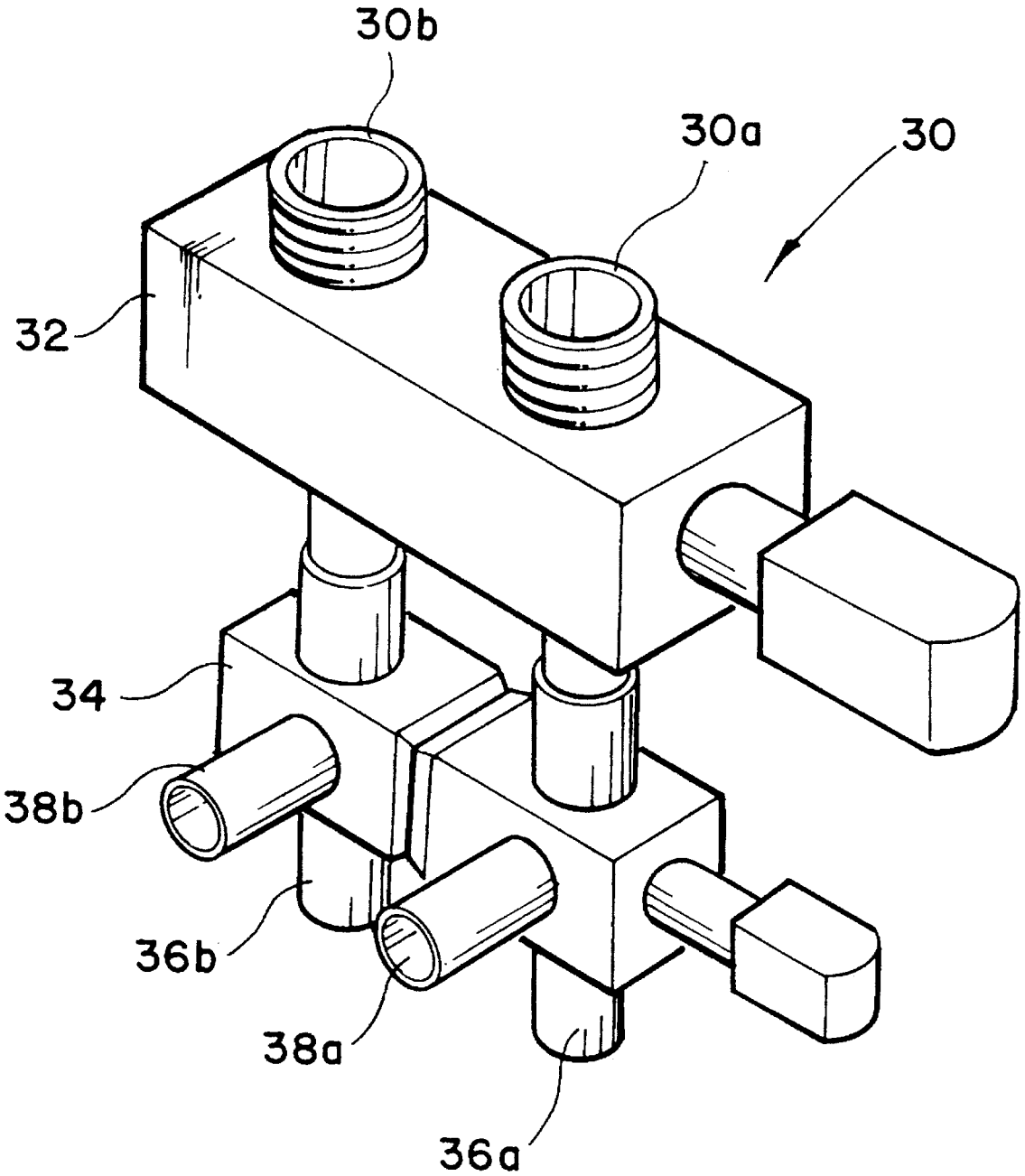
FIG. 5 is an enlarged perspective view of a water supply switching means in the embodiment of the present invention.

FIG. 5 is an enlarged perspective view of the water supply switching means 30 as illustrated in the FIG. 2 and 3.

The water supply switching means 30 comprises: an open/close valve 32 for opening and closing a passage of the cold water or warm water supplied from the faucet 6 of according to an input signal coming from a control panel 19 under the control the of the control means 40; and a switch valve 34 for supplying the cold water or warm water which has passed the open/close valve 32 to the water supply means 7 or to the water sprinkling means 20.

In the above description, the switch valve 34 comprises: a pair of first water supply holes 36*a* and 36*b* for supplying the cold water or warm water to the water supply means 7; and a pair of second water supply holes 38*a* and 38*b* for respectively supplying the cold water or warm water to the water sprinkling means 20 through the connecting pipes 28*a* and 28*b*.

Hereinafter, operations of the water supply apparatus according to the present invention thus constructed and effects thereof will be described in detail with reference to FIGS. 2, 3, 4, 5 and 6.

First of all, the laundry is inserted into the washing tub 4, a lid 18 is closed, and a washing condition is selected on the control panel 19 by the user.

The open/close valve 32 and the switch valve 34 in the water supply switching means 30 is activated by the control of the control means 40 according to the washing condition, to thereby cause the cold water or the warm water to be supplied to the water tub 2 through one of the first water supply holes 36*a* or 36*b* and through the water supply means 7.

The water level of the washing water supplied to the washing tub 4 is detected by a water level sensor 43 (see FIG. 6) to thereby be input to the control means 40.

The control means 40 receives the water level signal of the washing water detected by the water level sensor 43 to thereafter compare the same with a reference water level previously stored in the control means 40. If it is determined that the water level in the water tub 2 is above the predetermined reference water level, a motor 9 is activated by the control means 40.

At this time, when the motor 9 rotates a driving apparatus 3 through a belt 12, the rotation is then decelerated by the driving apparatus 3 to thereafter oscillate the pulsator 5, so that the water current can be formed in the washing tub 4 for washing of the laundry.

Next, when the washing is completed, the solenoid valve 8 is opened by the control means 40, thereby allowing the washing water to be discharged.

When the washing water is discharged, the motor 9 is activated by the control means 40, so that the driving apparatus 3 can rotate the washing tub 4 at high speed to thereby perform the spin-drying.

At this time, the pulsator 5 is not rotated because power is not transferred to the driving shaft 3*a* of the driving apparatus 3 which is connected to the pulsator 5.

The washing water supplied during or after the spin-drying by the control of the control means 40 to the water supply switching means 30 from the faucet 6 according to activation of the open/close valve 32 and the switch valve 34 of the water supply switching means is supplied to the water sprinkling means 20 through the pair of second water supply holes 38*a* and 38*b* of the water supply switching means 30, connecting pipes 28*a* and 28*b* and connecting holes 26*a* and 26*b*.

The rinsing water supplied to the water sprinkling means 20 is sprinkled into the washing tub 4 and water tub 2 through the sprinkling holes 24*a* and 24*b*.

Accordingly, the water sprinkled through the sprinkling holes 24*a* and 24*b* is evenly sprinkled and spread onto the laundry and the like in the water tub 2, to thereby wash away the soap suds.

The soap suds thus washed away are discharged to the outside along with the rinsing water through the water discharge valve 8.

Next, the water discharge valve 8 is closed by the control of the control means 40, and water is re-supplied to the water tub 2 through the water supply means 7. Thereafter, a number of rinsing cycles are performed to thereby complete the washing.

As seen from the foregoing, the water supply apparatus of the washing machine according to the present invention has an advantage in that the soap suds generated in the course of the washing and remaining in the washing tub 4 and the water tub 2 are eliminated by way of the sprinkling, which decreases the required number of rinsing cycles, shortens the washing time and reduces electric power consumption as well.

The foregoing description of the preferred embodiment has been presented for the purpose of illustration and description. It is not intended to limit the scope of this invention. Many modifications and variations are possible in light of the above teaching. It should be noted that the present invention can be applied to all Kinds of the apparatus within the scope of the above presentation. specifically, only explained the case where the cold water or warm water being supplied to on side of the water supply switching means is supplied to the sprinkling means, it should be apparent that the object of the present invention can be accomplished by supplying the cold water or warm water to the water supply means 7 could include a detergent dissolving apparatus mounted on the washing machine.

Furthermore, the water supply switching means could be divided into an open/close valve and a switching valve.

Still furthermore, the object of the present invention can be achieved by a construction where the switching means comprises two open/close valves.

What is claimed is:

1. A clothes washing machine comprising:

a water tub;

a washing tub disposed within said water tub;

water supply means for supplying fresh water from a fresh water source into said water tub, and water sprinkling means separate from said water supply means for sprinkling fresh water from the fresh water source into said water tub and into said washing tub, said water sprinkling means comprising a ring-shaped member disposed above an upper end of said washing tub and including water discharge holes formed in a bottom surface thereof, said holes spaced circumferentially apart with reference to a vertical axis of said washing tub; and switching means for supplying said fresh water selectively to said water supply means and said water sprinkling means.

2. The clothes washing machine according to claim 1, wherein said water-discharge holes include radially spaced inner and external holes; the inner holes arranged to direct water into said washing tub, said external holes arranged to direct water into a space formed radially between said washing tub and said water tub.

3. The clothes washing machine according to claim 1, wherein said switching means is connected to sources of hot water and cold water and is actuable to select water from said hot and cold water sources and supply the selected water to one of said water supply means and said water sprinkling means.

4. The clothes washing machine according to claim 3, wherein said switching means is connected to said sprinkling means by a hot water conduit and a cold water conduit.

5. The clothes washing machine according to claim 4, wherein said switching means comprises a first valve for selecting water from the sources of hot water and cold water, and a second valve for directing the selected water to one of said water supply means and said sprinkling means.

6. A clothes washing machine comprising:

a water container assembly including:

a water tub, and a washing tub disposed within said water tub in spaced relationship therewith, said washing tub including a floor and a pulsator mounted above said floor, said washing tub being rotatable about a vertical axis relative to said water tub;

water supply means for introducing fresh wash water from a fresh hot and cold water source into said water container assembly for performing a washing operation;

water sprinkling means separate from said water supply means for sprinkling fresh water from said fresh hot and cold water source into at least said washing tub, said water sprinkling means comprising a plurality of water-discharge holes disposed adjacent an upper end of said washing tub and spaced apart in a circumferential direction with reference to said vertical axis; and switching means for directing fresh water selectively to said wash water supply means and said sprinkling means from said source of fresh hot and cold water.

7. The clothes washing machine according to claim 6, wherein said water-discharge holes include radially spaced inner and external holes, said inner holes arranged to direct fresh water into said washing tub, said external holes arranged to direct fresh water into a space formed radially between said water tub and said washing tub.

* * * * *